United States Patent [19]

Brandell

[11] 4,086,851

[45] May 2, 1978

[54] GOLF BALL MARKERS

[75] Inventor: John R. Brandell, Glenview, Ill.

[73] Assignee: Brandell Products Corporation, Rosemont, Ill.

[21] Appl. No.: 761,313

[22] Filed: Jan. 21, 1977

[51] Int. Cl.[2] ..... B41F 17/30

[52] U.S. Cl. ..... 101/4; 101/28; 101/381; 101/398; 101/DIG. 17; 400/128

[58] Field of Search ..... 101/4, 28, 31, 398, 101/399, 381, 380, 377, 370, DIG. 17; 197/36

[56] References Cited

U.S. PATENT DOCUMENTS

| | | | |
|---|---|---|---|
| 441,822 | 12/1890 | Browning | 101/4 |
| 1,281,063 | 10/1918 | Pearson | 101/28 X |
| 1,537,685 | 5/1925 | Ladd | 101/4 |
| 1,641,562 | 9/1927 | Will et al. | 101/4 UX |
| 1,759,022 | 5/1930 | Putnam | 101/381 |
| 2,002,847 | 5/1935 | Atti | 101/4 X |
| 2,720,163 | 10/1955 | Shukal | 101/4 UX |
| 3,202,257 | 8/1965 | Rihm | 197/36 |
| 3,282,200 | 11/1966 | Brandell | 101/4 |

*Primary Examiner*—Clifford D. Crowder
*Attorney, Agent, or Firm*—Emrich, Root, O'Keeffe & Lee

[57] ABSTRACT

A golf ball marker embodying type-pieces which are so shaped that the ball engaging portions of the printing characters to be impressed into the ball conform to the curvature of the outer surface of the portion of the ball to be marked, and wherein the force applied to the type-pieces, during a marking operation, are such that all portions of the printing characters are pressed into the ball in a direction substantially normal to the ball surfaces engaged by such portions.

5 Claims, 10 Drawing Figures

GOLF BALL MARKERS

BACKGROUND OF THE INVENTION

The present invention relates to ball marking apparatus, and, more particularly, to ball marking apparatus which is particularly well adapted for marking golf balls.

It is a primary object to afford a novel golf ball marker.

The golf ball marker disclosed herein is of the same general type as the marker disclosed in my earlier U.S. Pat. No. 3,282,200, issued Nov. 1, 1966, which discloses a highly practical golf ball marker, which has enjoyed substantial commercial success. It is another object of the present invention to afford improvements over golf ball markers heretofore known in the art, including markers of the type disclosed in my aforementioned U.S. Pat. No. 3,282,200.

A disadvantage that has been common to golf ball markers heretofore known in the art in there inability to effectively mark golf balls having the tough, "no-cut" covers that have become popular in recent years, such as the golf balls having covers made from a suitable polymeric compound such as the ionomer resin available on the market under the trademark "Surlyn". It is an important object of the present invention to afford a novel golf ball marker which is operable to effectively impress printing characters into all types of golf balls, including balls having the aforementioned "no-cut" covers.

Another disadvantage that has been common to golf ball markers heretofore known in the art has been that they were not effective in the marking of golf balls except on the smooth circumferential surfaces thereof. As a result it has been necessary for golf balls, which are to be marked in such markers, to be properly indexed to dispose one of the three planes of smooth surfaces, commonly embodied on golf balls, in position to be markingly engaged by the printing characters to be impressed therein. It is another object of the present invention to afford a golf ball marker which is operable to effectively mark golf balls across any portion of the outer surfaces thereof, including the portions embodying the dimples or recesses therein, which are commonly embodied in golf balls to be found on the market.

Another object of the present invention is to afford a novel golf ball marker that is operable to effectively impress printing characters into portions of the outer surfaces of such golf balls, which portions are of such size that they include portions, at least, of a plurality of such dimples or recesses.

Yet another object of the present invention is to afford a novel golf ball marker which embodies a novel type-piece.

An object ancillary to the foregoing is to afford a novel, substantially U-shaped type-piece.

U-shaped type-pieces have been heretofore known in the art, being shown, for example in United States Letters Pat. No. 1,131,866, issued Mar. 16, 1915 to F. A. Putnam and C. F. Robbins. It is another object of the present invention to afford improvements over U-shaped type-pieces heretofore known in the art.

A further object is to afford a novel golf ball marker wherein the type-pieces are mounted in the marker in a novel and expeditious manner.

Another object of the present invention is to afford a novel golf ball marker of the aforementioned type, wherein the type-pieces may be quickly and easily removed and replaced.

A further object of the present invention is to afford a novel golf ball marker of the aforementioned type, which is practical and efficient in operation and which may be readily and economically produced commercially.

Other and further objects of the present invention will be apparent from the following description and claims and are illustrated in the accompanying drawings which, by way of illustration, show a preferred embodiment of the present invention and the principles thereof and which I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 1:
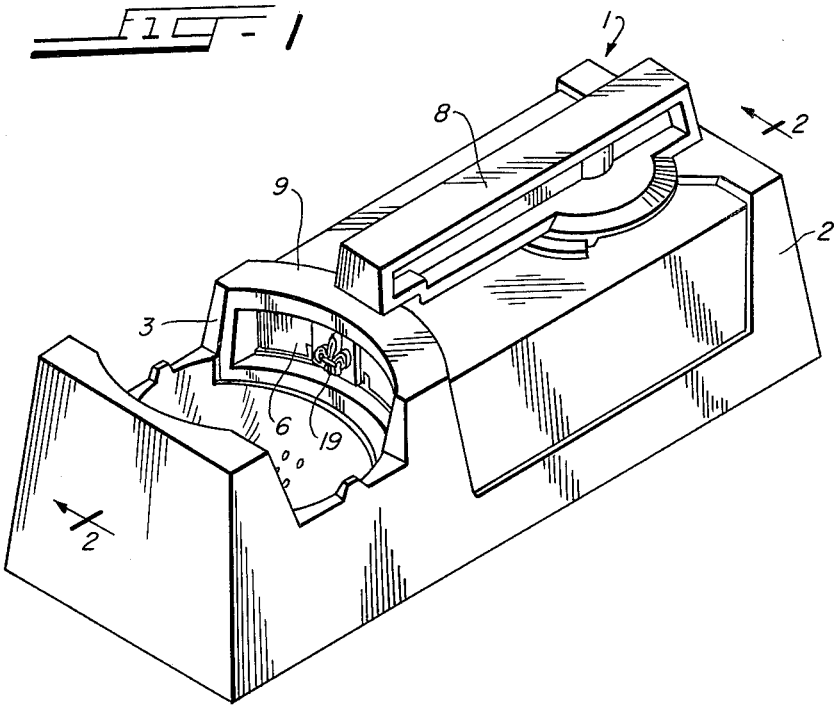
FIG. 1 is a perspective view of a golf ball marker embodying the principles of the presently preferred embodiment of the present invention.

A golf ball marker 1 is shown in the drawings to illustrate the presently preferred embodiment of the present invention. It is of the same general type as the marker shown in my aforementioned U.S. Pat. No. 3,282,200, but embodies improvements thereover, as will be discussed in greater detail presently.

Like the marker shown in the aforementioned U.S. Pat. No. 3,282,200, the marker 1 embodies an elongated frame or housing 2 having an upwardly opening recess or pocket 3 in the front end portion thereof for receiving a ball, such as the ball B, shown in FIG. 2, therein in position to be marked. Also, like my aforementioned earlier golf ball marker, the marker 1 embodies a type carrying member 4, which includes a cam-actuated, elongated slide or ram 5, having a type bar 6 mounted on the front end thereof, slidably mounted in the frame 2 for reciprocation longitudinally thereof. A cam member 7 extends vertically through the rear end portions of the frame 2 and the slide 5 and has a handle 8 mounted on the upper end thereof, FIG. 2.

Figure 2:
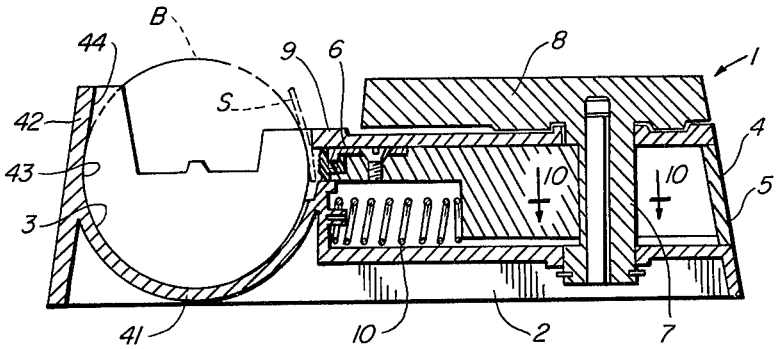
FIG. 2 is a longitudinal sectional view taken substantially along the line 2—2 in FIG. 1, and showing a golf ball disposed in position to be marked.
Figure 3:
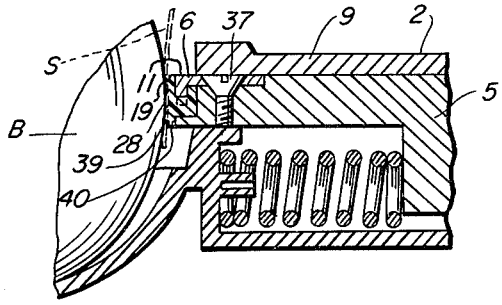
FIG. 3 is a fragmentary, detail sectional view of a portion of the golf ball marker shown in FIG. 2, with certain parts thereof shown in different position.
Figure 4:
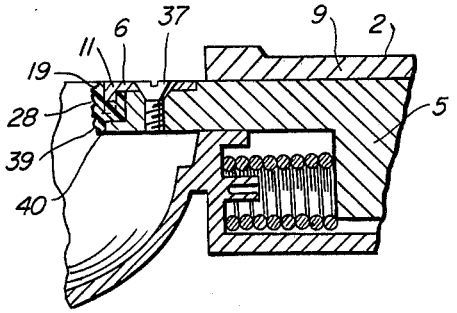
FIG. 4 is a view similar to FIG. 3, but showing certain parts of the marker in different position.

As in the golf ball marker shown in the aforementioned U.S. Pat. No. 3,282,200, rotation of the handle 8 in a clockwise direction, as viewed in FIG. 1, is effective to cam the slide 5 forwardly from its normal at-rest position, shown in FIG. 2, into a ball-marking position, as shown in FIG. 3; and rotation of the handle 8 in a counter-clockwise direction is effective to cam the slide 5 forwardly into a further extended position, as shown in FIG. 4, wherein the type bar 6 is disposed in overlying relation to the pocket 3, forwardly of the top wall 9 of the housing 2 for a purpose which will be discussed in greater detail presently. A compression coil spring 10, FIG. 2, is mounted in the frame 2 in position to urge the slide 5 rearwardly, and, when the handle 8 is turned from actuated position back toward the normal at-rest position thereof shown in FIG. 1, the spring 10 is effective to return the slide 5 to its normal, at rest position shown in FIG. 2.

Figure 5:
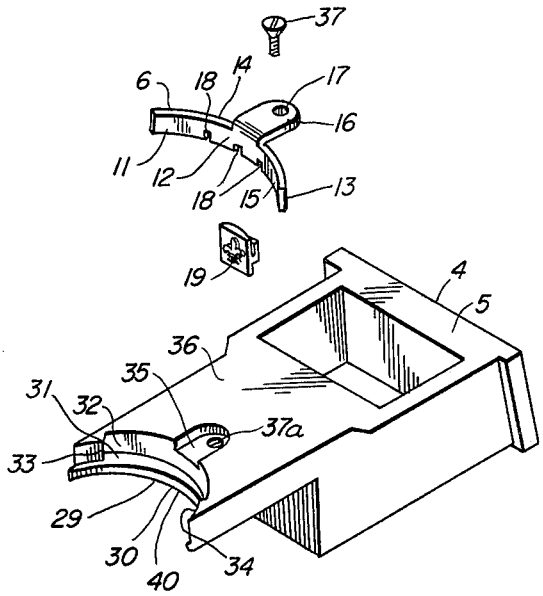
FIG. 5 is an exploded perspective view of a portion of a golf ball marker shown in FIG. 2.

The type bar 6 embodies an elongated, arcuate-shaped body member 11, which is complimentary in curvature to the outer surface of a ball to be marked, and has a front face 12, a rear face 13, an upper longitudinal edge portion 14 and a lower longitudinal edge portion 15, FIG. 5. An elongated, substantially flat flange or ear 16, having a hole 17 extending vertically therethrough, projects rearwardly from the upper longitudinal edge portion 14 of the body member 11. Three notches or recesses 18 are formed in the lower longitudinal edge portion 12 of the body portion 11 of the type bar 6, and are equally spaced along the body portion 11 with the central one of the notches 18 disposed midway between the ends of the body portion 11.

Figure 6:
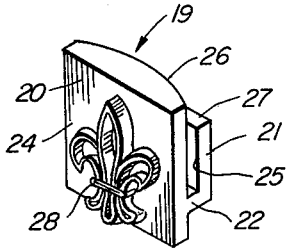
FIG. 6 is a perspective view of the type-piece shown in FIG. 1.

In the assembled golf ball marker 1, one or more type-pieces, such as the type-piece 19 shown in FIG. 6, are mounted on the body portion 11 of the type bar 6, one type-piece 19 being shown so mounted in FIG. 1. The type-piece 19 is substantially U-shaped, having a front wall 20 and a rear wall 21, interconnected by transverse wall 22, which extends forwardly from the lower end of the rear wall 21, FIG. 6. An elongated abutment member, or ridge 23 projects upwardly from the upper face of the transverse wall 22 and extends between the walls 20 and 21 midway between the lateral ends thereof, FIGS. 7 and 8. The abutment member 23 is complimentary in size and shape to each of the notches 18, and, when the type-piece 19 is disposed in operative position on the type bar 6 the abutment member 23 is disposed in one of the notches 18, as will be discussed in greater detail presently.

Figure 7:
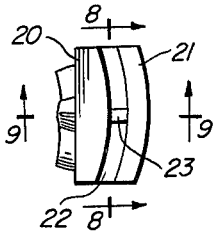
FIG. 7 is a top plan view of the type piece shown in FIG. 6.
Figure 8:
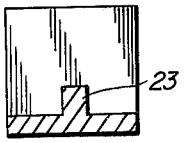
FIG. 8 is a detail sectional view taken substantially along the lines 8—8 in FIG. 7.

The walls 20 and 21 of the type-piece 19 embody front faces 24 and 25 and rear faces 26 and 27, respectively, FIG. 6. The front face 24 is substantially flat and the other faces 25–27 are arcuate in horizontally transverse shape, and are disposed in parallel relation to each other, as shown in FIG. 7. A printing character 28 projects forwardly from the front face 24 of the wall 20, FIG. 6, and in the preferred form of the type piece 19, the front face of the printing character 28 is concave in shape, having the same curvature in all directions as that of the outer surface of a golf ball to be marked in the marker 1 and having a curvature in the horizontal direction which is the same as the faces 25–27 of the type piece 19, so that it is parallel thereto in this direction.

The curvature of the faces 25–27 of the type-piece 19 is the same as that of the body portion 11 of the type bar 6, and when the type-piece 19 is mounted in operative position on the type bar 6 the front wall 20 is disposed forwardly of the body portion 11 of the type bar 6 with the rear face 26 thereof disposed in overlying, abutting engagement with the front face 12 of the body portion 11; the rear wall 21 is disposed rearwardly of the body portion 11 of the type bar 6, with the front face 25 of the wall 21 disposed in overlying abutting engagement with the rear face 13 of the body portion 11; and the upper face of the transverse wall 22 is disposed in underlying, abutting engagement with the lower longitudinal edge portion 15 of the body portion 11, with the abutment member 23 disposed in a respective one of the notches 18. When a single type-piece 19 is thus mounted on the type bar 6, it preferably is disposed in centered position longitudinally of the body portion 11, as shown in FIG. 1, in which position, the abutment member 23 is disposed in the central one of the notches 18.

The slide 5 has a forwardly concave, arcuate recess 29 formed in the front end thereof, FIG. 5. The recess 29 has a shelf 30, having an upper face 31, formed in, and defining the lower edge portion thereof. The recess 29 also has an elongated face 32, which projects laterally upwardly from the top face 31 of the shelf 30, in substantially perpendicular relation thereto, two radially projecting shoulders 33 and 34 in the recess 29 defining the respective ends of the face 32. Another recess 35, which is complimentary in size and shape to the tongue 16 on the type bar 6 is formed in the upper face 36 of the slide 5 and projects rearwardly from the longitudinal central portion of the face 32 of the recess 29.

The recess 29 is of such size, between the abutment members 33 and 34, that the type bar 6, with type-pieces 19 disposed in operative position thereon, may be moved downwardly into operative position in the recess 29 wherein the body portion 11 of the type bar 6 is disposed in the recess 29 with the opposite ends of the body portion 11 disposed in abutting engagement with respective ones of the abutment members 33 and 34, and with the lower faces of the transverse walls 22 of the type-pieces 19, mounted on the type bar 6, resting on the upper face 31 of the shelf 30, and with the tongue 16 of the type bar 6 disposed in the recess 35 in the slide 5. With the type bar 6 thus disposed in operative position in the recess 29, it may be secured to the slide 5 by suitable means such as a screw or bolt 37 inserted downwardly through the opening 17 in the tongue 16, and threaded into an opening 37A in the portion of the slide 5 underlying the recess 35.

Figure 9:
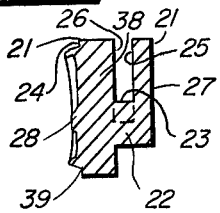
FIG. 9 is a detail sectional view taken substantially along the line 9—9 in FIG. 7.

In the preferred form of the type-pieces 19, the walls 20 and 21 thereof preferably are of the same horizontal width, FIG. 7, but the front wall 20 preferably is of greater vertical width than the rear wall 21, projecting both upwardly above the rear wall 21 and downwardly below the rear wall 22, FIGS. 6 and 9. Preferably, the vertical width of the rear walls 21 of the type-pieces 19 is such that when the type-pieces 19 are disposed in the aforementioned operative position on the type bar 6, the upper edge of the rear wall 21 of the type-piece 19, when the latter is disposed in centered relation to the length of the body portion 11 of the type bar 6, is disposed in closely underlying relation to the lower face of the tongue 16, as shown in FIG. 4. On the other hand, preferably, the vertical width of the front walls 20 of the type pieces 19 is such that when the type pieces are disposed in operative position on the type bar 6, and the latter is disposed in operative position in the recess 29 in the slide 5, the portion 38 of the front wall 20, which projects upwardly from the transverse wall 22 completely vertically covers the front face 12 of the body portion 11 of the type bar 6, and terminates at its upper edge in uniplanar relation to the upper longitudinal edge 14 thereof; and the portion 39 which projects downwardly below the transverse wall 22 is disposed in overlying, abutting juxtaposition to the front face 40 of the shelf 30 and terminates at its lower edge in uniplanar relation to the lower edge of the shelf 30.

In the preferred form of the golf ball marker 1, the curvature of the faces 32 and 40 of the recess 29 is the same as the curvature of the faces 25–27 of the type-pieces 19, and it will be seen that with this construction, the type-pieces 19 are firmly held, in a positive manner against deflection and rearward displacement not only by the type bar 6, but also, by the front end portion of the slide 5. In the preferred form of the golf ball marker 1, the frame 2, the slide 5, the handle 8 and the cam member 7 may be made of any suitable material, but, preferably, are made of a suitable plastic, such as, for example, high impact polystyrene; the type bar 6 may be made of any suitable material, but, preferably, is made of spring steel; and the type-pieces 19 may be made of any suitable material, such as, for example, steel, but, preferably, are made of a suitable, hard, synthetic material, such as, for example, glass-impregnated nylon.

The ball holding pocket 3 is defined by an upwardly concave, hemispherically-shaped wall 41, terminating at its upper front end portion 42, which forms a rearwardly inclined concave surface extending above the horizontal plane through the equatorial portions of a ball, such as the ball B, disposed in marking position in the pocket 3, to thereby aid in retaining the ball in the pocket during the marking operation, the rearward inclination of the upper portion 42 of the wall 41 being preferably of the order of 0.129 inch per inch. The front wall of the pocket 3 thus provides a rearwardly facing abutment 43 for engaging equatorial portions of the ball in the pocket. In the assembled golf ball marker 1, the type-pieces 19 are disposed diametrically opposite the abutment 43. Accordingly, marking pressure may be exerted on a ball disposed in the pocket 3 by squeezing antipodally disposed, equatorially located portions of the ball in the pocket by and between the abutment 43 and the type-pieces 19 mounted on the forward end of the slide 5. Since the rear face 44 of the upper end portion 42 of the wall 41 slightly overhangs the equatorial portions of the ball B, marking pressure of the type-pieces 19 will not dislodge the ball upwardly from marking position in the pocket 3.

Figure 10:
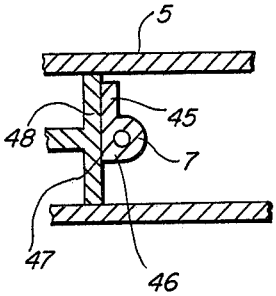
FIG. 10 is a detail sectional view taken substantially along the line 10—10 in FIG. 2.

It will be remembered that the cam shaft 7 has a handle 8 on the upper end thereof and that rotation of the handle 8 from its normal at-rest position, shown in FIG. 1, is effective to cause the slide 5 to move forwardly in the frame 2. Such movement of the slide 5 is effected by two axially aligned cam lobes 45 and 46 projecting outwardly in opposite directions from the cam shaft 7, FIG. 10, and having a flat face 47 disposed in abutting engagement with the rear face of a transverse partition wall 43 in the slide 5.

The handle 8 is preferably several times longer than the cam lobes 45 and 46. For example, the handle 8 may have an overall length of the order of 3 inches, with its front end extending radially from the axis of the cam 7 a distance of the order of 2 and 3/16 inches, as compared with a radial dimension of the order of $\frac{3}{8}$ and $\frac{1}{4}$ inch for the lobes 45 and 46, respectively. With this construction, rotation of the handle 8 in a counter-clockwise direction, as viewed in FIG. 1, from its normal at-rest position is effective to move the cam lobe 45 forwardly and thus cam the slide 5 forwardly a substantial distance, such as shown in FIG. 4; and rotation of the handle 8 in a clockwise direction from its normal at-rest position is effective to move the cam lobe 46 forwardly and thus cam the slide 5 forwardly a lesser distance, as shown in FIG. 3, in a ball-marking operation. The flat face 47 of the cam lobes 46 being spaced from the axis of the cam 7 a relatively short distance, of the order of 1/6 inch, a relatively small turning force on the handle 8 is effective to exert a substantial marking force of the type-pieces 19 against the ball B.

In the operation of the golf ball marker 1, the handle 8 may be turned in a counter clockwise direction, as viewed in FIG. 1, from its normmal at-rest position to thereby advance the slide 5 forwardly in the frame 2 into the aforementioned position wherein the type bar 6 is disposed forwardly of the front wall 9 of the frame 2, as shown in FIG. 4. In such position of the slide 5, the type bar 6 may be readily removed therefrom by removing the screw 37 and then the type-bar 6. Thereafter, one or more type-pieces, such as the type-piece 19, FIG. 6, may be mounted in the aforementioned operative position on the type bar 6, wherein they are disposed in resilient, clamping engagement with the body portion 11 of the type bar 6 with the abutment members 23 disposed in respective ones of the notches 18. The type bar 6 with the type pieces 19 disposed thereon may then be reinserted onto the front end portion of the slide 5 and again secured in position thereon by the screw 37. The handle 8 may then be turned back into its normal at-rest position to thus dispose the slide 5 in its normal, at-rest position, as shown in FIG. 2.

When it is desired to mark a ball, such as the ball B, shown in FIG. 2, the ball may be manually inserted into the pocket 3, with the slide 5 disposed in the position shown in FIG. 2 and an ink transfer sheet S may be inserted into the space between the ball B and the type-piece or pieces 19 mounted on the slide 5, FIG. 3. Any suitable ink transfer material may be used, but the strips S preferably are of the sort made of a tough, pliable material, such as cellophane or polyethylene, having a face thereof coated with printing ink. In mounting a strip S in ball-marking position, its ink carrying surface, is, of course, turned toward the surface of the ball to be marked.

After a ball B and strip S have thus been disposed in the pocket 3, the handle 8 may be turned in a clockwise direction, as viewed in FIG. 1, to thus advance the slide 5 forwardly into position to firmly press the printing characters 28 on the type pieces 19 into impressing relation to the adjacent surface of the ball B.

With the front faces of the printing characters 28 on the type-pieces 19 being curved to conform to the curvature of the portions of the ball to be engaged thereby, the imprinting force applied to the surface of the ball is substantially directly radially inwardly relative thereto across the entire face of the printing character. With this construction and arrangement of parts, the imprinting force is substantially equal at all portions of the printing characters, and all portions of the front face of the printing characters engage the surface of the ball at substantially the same time. Thus, a highly legible, uniform printing impression is made in a ball, such as the ball B, by the type-pieces 19 embodied in the golf ball marker 1.

Also, with this construction, all of the portions of the front face of the printing characters 28 are impressed into the curved outer surface of the ball being marked substantially the same distance, which assists in insuring that a clear, legible printing impression will be made in the ball, even though the individual printing characters 28 extend across a plurality of dimples or portions of dimples in the outer surface of the ball.

From the foregoing it will be seen that the present invention affords a novel golf ball marker.

Also, it will be seen that the present invention affords novel type-pieces for use in a golf ball marker.

In addition, it will be seen that the present invention affords a novel golf ball marker wherein type-pieces are operatively mounted therein in a novel and expeditious manner.

Also, it will be seen that the present invention affords a novel golf ball marker which is practical and efficient in operation and which may be readily and economically produced commercially.

Thus, while I have illustrated and described the preferred embodiment of my invention, it is to be understood that this is capable of variation and modification, and I therefore do not wish to be limited to the precise details set forth, but desire to avail myself to such changes and alterations as fall within the purview of the following claims.

I claim:

1. A ball marker comprising a. an elongated frame forming an upwardly opening pocket, at one end of said frame, for receiving a ball in position to be marked, b. said pocket embodying a front rearwardly facing wall portion circularly curved in conformity with the circumference of the ball to be marked and forming an abutment for engaging equatorial portions of a ball in the pocket, c. a type carrying member mounted in said frame at the side of said pocket diametretically opposite said abutment, d. a type-piece having a substantially U-shaped portion comprising two substantially parallel, spaced walls, e. each of said walls having
(1) an outer face facing away from the other of said walls, and
(2) an inner face facing toward the other of said walls, f. the outer face on one of said walls having a printing character projecting therefrom, g. said type piece being mounted on a portion of said type carrying member
(1) with said inner faces disposed in abutting juxtaposition to opposite sides of said last mentioned portion, and
(2) with said printing character facing toward said abutment, and h. means mounted on said frame and operatively connected to said type carrying member for reciprocating said type carrying member longitudinally of said frame into and out of position to markingly press said printing character into engagement with equatorial portions of said ball disposed antipodally with respect to the abutment engaging equatorial portions thereof, i. the face of said printing character remote from said outer face on said one wall being circularly curved in conformity with the circumference of the ball to be marked, j. said inner faces of said walls and said outer face of the other of said walls being parallel to said face of said printing character, k. said opposite sides of said portion of said type carrying member being parallel to said inner faces of said walls, l. said portion of said type carrying member comprising the body portion of a type bar, m. said body portion of said type bar
(1) including a longitudinal edge portion, and
(2) having a notch formed in said longitudinal edge portion, n. said type-piece including
(1) a transverse wall extending between said parallel walls, and
(2) an abutment member, which is substantially complementary in size and shape to said notch, on said transverse wall and projecting between said parallel walls, and o. said type-piece being mounted on said type bar with
(1) said transverse wall disposed in abutting engagement with said longitudinal edge portion, and
(2) said abutment member disposed in said notch.

2. A ball marker as defined in claim 1, and in which a. said type carrying member includes a slide slidably mounted in said frame for reciprocation longitudinally thereof, b. said slide includes
(1) a shelf, and
(2) a face projecting upwardly from said shelf, c. said type bar is mounted on said slide with
(1) said transverse wall of said type piece resting on said shelf, and
(2) said outer face of the other of said walls of said type piece, remote from said printing character, disposed in abutting juxtaposition to said face of said slide, and d. said face of said slide is parallel to said face of said printing character.

3. A ball marker as defined in claim 2, and in which a. the top of said one wall of said type-piece is disposed in substantially uniplanar relation to the top of said type bar, and b. the bottom edge portion of said type-piece
(1) projects downwardly below said type bar, and
(2) is disposed in overlying, abutting juxtaposition to said shelf.

4. In a ball marker of the type embodying means for holding a ball in operative position to receive a marking impression thereon from a printing character, the combination of a. a type-piece having such a printing character projecting outwardly from an outer face thereof, b. the face of said printing character remote from said face of said type-piece being circularly curved in conformity with the circumference of the portion of said ball to receive said impression, and c. means for moving said type-piece toward and away from said ball into and out of position to move said printing character into and out of such impression marking relation of said portion of said ball d. said means for moving said type-piece including a type bar having two oppositely disposed faces, e. said type piece (1) being substantially U-shaped,
(2) including two substantially parallel walls, and
(3) being removably mounted on said type bar with said walls disposed in abutting juxtaposition with respective ones of said faces of said type bar, f. each of said walls embodying an inner face and an outer face, g. one of said last mentioned outer faces being substantially flat, h. said printing character projecting outwardly from said one outer face, and i. said inner faces and the other of said outer faces being substantially parallel to each other and to said faces of said type bar and to said face of said printing character, j. said type bar including a longitudinal edge portion having a notch therein, k. said type-piece including a transverse wall
(1) extending between said parallel walls, and
(2) having an abutment, which is substantially complementary in size and shape to said notch, disposed between said parallel walls, and l. said type-piece being mounted on said type bar with
(1) said transverse wall disposed in abutting engagement with said longitudinal edge portion, and
(2) said abutment member disposed in said notch.

5. A ball marker comprising a. an elongated frame forming an upwardly opening, pocket, at one end of said frame, for receiving a ball in position to be marked, b. said pocket embodying a front rearwardly facing wall portion circularly curved in conformity with the circumference of the ball to be marked and forming an abutment for engaging equatorial portions of a ball in the pocket, c. a type carrying member mounted in said frame at the side of said pocket diametrically opposite said abutment, d. said type carrying member comprising
(1) a slide slidably mounted in said frame for reciprocation longitudinally thereof, and
(2) a type bar removably mounted on said slide, e. said type bar having an outer edge, f. a type-piece having a substantially U-shaped portion comprising
(1) two substantially parallel, spaced walls, and
(2) a transverse wall extending between said spaced walls g. each of said spaced walls having
(1) an outer face facing away from the other of said spaced walls, and
(2) an inner face facing toward the other of said spaced walls, h. the outer face on one of said walls having a printing character projecting therefrom, i. the face of said printing character remote from said outer face on said one wall being circularly curved in conformity with the circumference of the ball to be marked, j. said type piece
(1) being mounted on said type bar with
(a) said inner faces disposed in abutting juxtaposition to opposite sides of said type bar,
(b) said printing character facing toward said abutment, and
(c) said transverse wall being disposed in abutting juxtaposition to said outer edge, and
(2) being removable from said type bar laterally across said outer edge, and k. means, including a slide, mounted on said frame and operatively connected to said type carrying member for reciprocating said type carrying member longitudinally of said frame into and out of position to markingly press said printing character into engagement with equatorial portions of said ball disposed antipodally with respect to the abutment engaging equatorial portions thereof, l. said slide including
(1) a shelf, and
(2) a face projecting upwardly from said shelf, and m. said type bar being mounted on said slide with
(1) said transverse wall of said type piece resting on said shelf, and
(2) said outer face of the other of said walls of said type piece, remote from said printing character, disposed in abutting juxtaposition to said face of said slide.

* * * * *